US006964229B1

(12) United States Patent
Zimmerman

(10) Patent No.: US 6,964,229 B1
(45) Date of Patent: Nov. 15, 2005

(54) METHOD FOR RECORDING MULTI-EVENT SPORTS MEET INFORMATION ON SKIN

(76) Inventor: Terri Chassay "T. C." Zimmerman, 13571 Monte Vedra Rd., SE., Huntsville, AL (US) 35803

( * ) Notice: Subject to any disclaimer, the term of this patent is extended or adjusted under 35 U.S.C. 154(b) by 0 days.

(21) Appl. No.: 10/843,063

(22) Filed: May 11, 2004

(51) Int. Cl.[7] ..... B41J 1/22
(52) U.S. Cl. ..... 101/483; 101/109; 101/368
(58) Field of Search ..... 101/483, 109, 101/368

(56) References Cited

U.S. PATENT DOCUMENTS

| | | | | |
|---|---|---|---|---|
| 2,918,731 | A * | 12/1959 | Warhaftig et al. | 434/272 |
| 3,403,623 | A * | 10/1968 | Blackwood | 101/368 |
| 3,951,062 | A * | 4/1976 | Abramson | 101/483 |
| 4,610,806 | A * | 9/1986 | Rosen | 252/301.16 |
| 4,676,162 | A | 6/1987 | Phipps, Sr. et al. | |
| 4,927,695 | A | 5/1990 | Ooms et al. | |
| 5,049,432 | A | 9/1991 | Ooms et al. | |
| 5,152,223 | A | 10/1992 | Mairon | |
| 5,313,885 | A | 5/1994 | Winston | |
| 5,517,916 | A | 5/1996 | Dour et al. | |
| 5,738,011 | A | 4/1998 | Tay | |
| 5,743,899 | A * | 4/1998 | Zinreich | 606/1 |
| 5,812,049 | A * | 9/1998 | Uzi | 340/323 R |
| 6,286,682 | B1 * | 9/2001 | d'Arbelles | 206/570 |
| 6,360,658 | B1 * | 3/2002 | Benson | 101/109 |
| 6,679,168 | B1 | 1/2004 | Shih | |
| 2002/0069776 | A1 | 6/2002 | MacNeil | |
| 2003/0104127 | A1 | 6/2003 | Katzen et al. | |
| 2003/0150343 | A1 | 8/2003 | Koneczny | |

OTHER PUBLICATIONS

Http:www.zionsvilleswimclub.org/tips.htm; Zionville Swim Club; Zionsville, Indiana 46077.*

* cited by examiner

*Primary Examiner*—Ren Yan
*Assistant Examiner*—Andrea H. Evans
(74) *Attorney, Agent, or Firm*—Lanier Ford Shaver & Payne; George P. Kobler

(57) ABSTRACT

A method for recording multi-event athletic meet information on skin comprises the steps of printing an array on an athlete's skin and then populating the array with competition information, which may include such information categories as event description, heat number and lane number.

8 Claims, 2 Drawing Sheets

FIG. 1
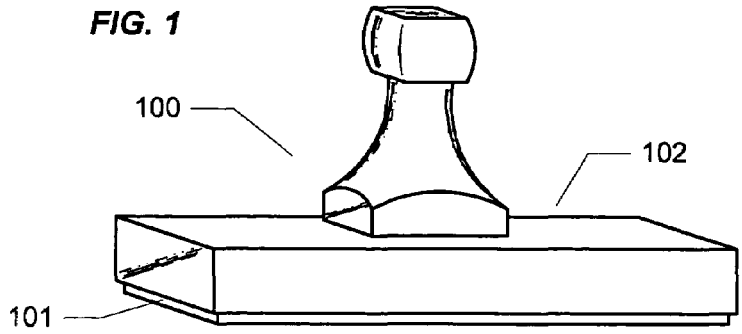
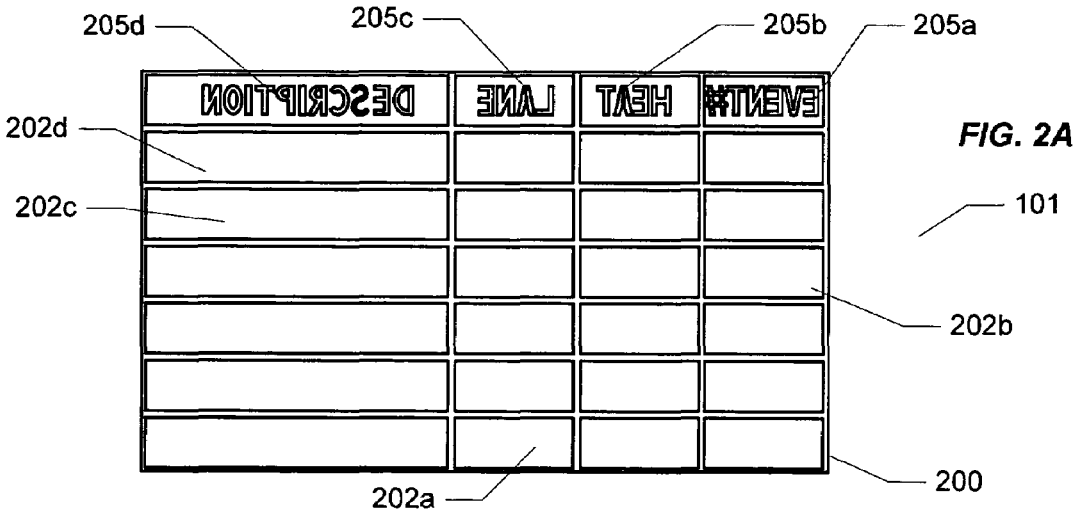
FIG. 2A
FIG. 2B
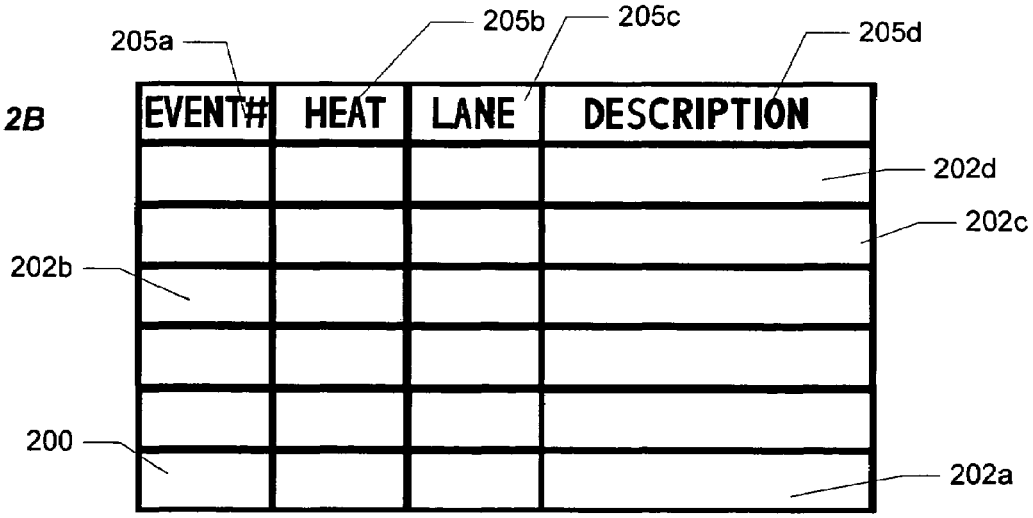

METHOD FOR RECORDING MULTI-EVENT SPORTS MEET INFORMATION ON SKIN

BACKGROUND

Description of the Related Art

Many multi-event sports meets are held in which athletes of all ages compete. Swimming meets, gymnastics meets, and track-and-field meets are examples. For example, swimming meets conduct individual racing competitions in four strokes, each in varying distances, and relay races of various strokes and distances. Similarly, track meets conduct individual running races of varying distances, as well as relay races of varying distances.

Where there are many athletes participating in each event, such multi-event sports meets typically run one or more preliminary heats in each event where the athletes competing in a given heat have substantial similar performance metrics. For example, in a swim meet one event for one stroke may include several heats with the first heat conducted comprising the slower swimmers based upon time to complete the distance and the next heat comprising somewhat faster swimmers and so on.

Often the information related to when an athlete is to compete in a preliminary heat during the meet is published in a program or booklet and distributed prior to the start of the meet. Athletes at some meets include children from as young as age 6 or 7 who cannot decipher such a booklet without the aid of an older person. Some parents or sitters of such younger children have resorted to extracting information pertinent to a child and writing it on the child's skin with a pen so that the child can have the information with her throughout the day or the meet depending upon how long the ink stays visible on the skin.

However, this procedure tends to be unorganized and unkempt. In the worst case, the athletes' skin may have ink on many different parts of the body. Therefore, what is needed is an advantageous method for recording such information on the athlete's skin.

SUMMARY

The present disclosure is directed to a method that satisfies this need.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein.

The method comprises the steps of printing an array on an athlete's skin and then populating the array with competition information, which may include such information categories as event description, heat number and lane number. The array is printed upon the skin using an ink stamp where the stamp is configured to display and array having rows and columns. Populating the array may be done by hand-writing the information into the rows and columns, preferably with an ink pen. Both the ink used to print the array and that used to write the information may be resistant to erasure from exposure to liquid, including water or perspiration.

These and other embodiments of the present invention will also become readily apparent to those skilled in the art from the following detailed description of the embodiments having reference to the attached figures, the invention not being limited to any particular embodiment(s) disclosed.

BRIEF DESCRIPTION OF THE DRAWINGS

The present invention is described with reference to the accompanying drawings. In the drawings, like reference numbers indicate identical or functionally similar elements. Additionally, the left-most digit(s) of a reference number identifies the drawing in which the reference number first appears.

FIG. 1 depicts an exemplary ink stamp for use in the present inventive method;

FIG. 2A depicts an exemplary die for use in the present inventive method;

FIG. 2B depicts the display rendered by the die in ink when stamp is impressed upon a surface;

DETAILED DESCRIPTION

Figure 3:
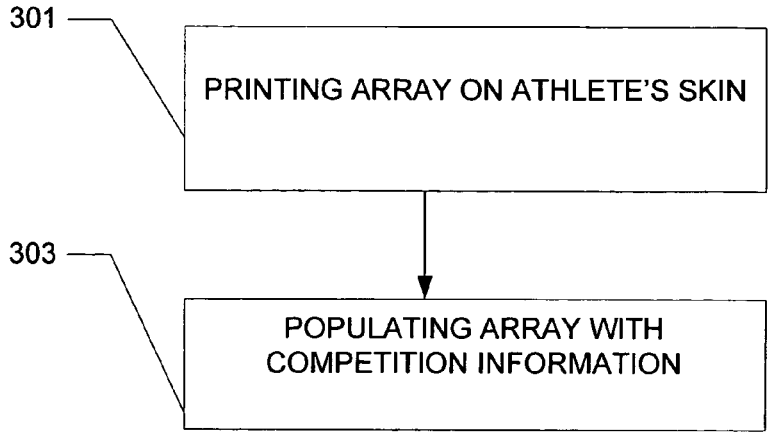
FIG. 3 is a flow-chart illustrating the steps of the inventive method.

The various embodiments of the present invention and their advantages are best understood by referring to FIGS. 1 through 3 of the drawings. The elements of the drawings are not necessarily to scale, emphasis instead being placed upon clearly illustrating the principles of the invention. Throughout the drawings, like numerals are used for like and corresponding parts of the various drawings.

An ink stamp 100 having stamp body 102 and die 101 that has been adapted to provide the image of a grid, or array, when ink is applied to die 101 and die 101 is pressed onto a surface. Array 200 is a two-dimensional array with spaces 202 *a–d* to record pertinent meet information. Array 200 in FIG. 2 is an exemplary array, used in the case of a swimming meet, and provides spaces to meet information categories 205*a–d* such as record event number, event description, heat number, lane number and event description or title. Array may accommodate meet information in numerous configurations including columns and rows. Meet information categories 205*a–d* may appear in any order within the array. Meet information categories 205*a–d* need not be represented by the full word as shown in FIG. 2, but also by abbreviations. For example, the category "EVENT" could be represented by "EVT" or simply "E." "LANE" could be represented by "LN" or simply "L" and so forth.

Array 200 comprises enough rows to accommodate all event listings in which an athlete may compete during at least one day of a multi-event athletic meet. The number of rows should be at least five to ensure sufficient accommodation of event competition information, but the number of rows could vary.

While larger dies may be used to accommodate the entry of more events, die 101 can be about 3 inches in width and 2.5 inches in height with the height of each of the spaces 202*a–d* sufficient to accommodate hand-written legible notation, generally between about 0.25 inches and 0.75 inches. Once array 200 is printed upon the athlete's skin, a pen could be used for populating the array and preferably a medium point pen, and still more preferably a felt tip pen. In the alternative, array 200 may be populated using another stamp for information that is repeated from meet to meet. For example, if the athlete tends to participate in the same events in a plurality of meets, those event descriptions could be formed in a die 101 and then printed within array 200. Also, some information need not be in text form, but may be symbolically, or iconically represented. For instance, if in a swimming meet, an event is a competition of the butterfly swimming stroke, the event description could be a symbol or icon representing the butterfly stroke. In track-and-field meets, the hurdle competition could be represented symbolically or iconically. The ink used to print the array and to populate the array may be an ink resistant to erasure when exposed to water or perspiration.

The inventive method, therefore, includes the steps of printing on the skin of an athlete an array 301 and populating the array with the athlete's competition information 303. The competition information may include at least the event description, the heat number and lane number, if applicable. Stamp 100 may be self-inking stamp such as that described in U.S. Pat. No. 5,517,916 to Dour, et al. For that matter, stamp 100 may be any type of ink stamp known in the art having a post as shown in FIG. 1, or not. Stamp 100 could be made of any material suitable for supporting die 101 including wood, plastic or metal. Stamp 100 can also be of various colors and display on any suitable surface of stamp body 102, various decorative pictures, including, for example, team logos.

In the alternative, Array 200 could be printed upon the athlete's skin using a temporary tattoo. Methods for imprinting temporary tattoos on skin are well-known. Some exemplary methods are described in U.S. Pat. No. 6,106,852 to Vineberg, U.S. Pat. No. 5,578,353 to Drew, and U.S. Pat. No. 5,601,859 to Penaluna.

It is known in the relevant arts that temporary tattoos may be generated by an automated system. In other words, the design for a temporary tattoo may be generated by a computer system and then output using an appropriately configured printer upon commercially available temporary tattoo decal paper.

An athlete-specific competition data array may be generated by software executes on one or more computers and may be locally or remotely accessible. The computers may be uniprocessor or multiprocessor machines. Additionally, these computers include an addressable storage medium or computer accessible medium, such as random access memory (RAM), erasable programmable read-only memory (EPROM), read-only memory (ROM), hard disks, floppy disks, laser disk players, optical disk players, digital video devices, and other components operable to transmit and/or store data. The verification tool is advantageously configured reside on the addressable storage medium and configured to execute on one or more processors.

The detailed description that follows is presented largely in terms of processes and symbolic representations of operations performed by conventional computers, including computer components. A computer may be any microprocessor or processor (hereinafter referred to as processor) controlled device, such as, by way of example, personal computers, workstations, servers, clients, mini-computers, main-frame computers, laptop computers, a network of one or more computers, mobile computers, portable computers, handheld computers, palm top computers, set top boxes for a TV, interactive televisions, interactive kiosks, personal digital assistants, interactive wireless devices, mobile browsers, or any combination thereof. The computer may possess input devices such as, by way of example, a keyboard, a keypad, a mouse, a microphone, or a touch screen, and output devices such as a computer screen, printer, or a speaker.

The computer may be a uniprocessor or multiprocessor machine. Additionally, the computer includes memory such as a memory storage device or an addressable storage medium. The memory storage device and addressable storage medium may be in forms such as, by way of example, a random access memory (RAM), a static random access memory (SRAM), a dynamic random access memory (DRAM), an electronically erasable programmable read-only memory (EEPROM), a programmable read-only memory (PROM), an erasable programmable read-only memory (EPROM), hard disks, floppy disks, laser disk players, digital video disks, compact disks, video tapes, audio tapes, magnetic recording tracks, electronic networks, and other devices or technologies to transmit or store electronic content such as programs and data.

The computer executes an appropriate operating system such as Linux, Unix, Microsoft® Windows® 95, Microsoft® Windows® 98, Microsoft® Windows® NT, Apple® MacOS®, IBM® OS/2®, and the like. The computer may advantageously be equipped with a network communication device such as a network interface card, a modem, or other network connection device suitable for connecting to one or more networks.

The computer, and the computer memory, may advantageously contain program logic or other substrate configuration representing data and instructions, which cause the computer to operate in a specific and predefined manner as, described herein. The program logic may advantageously be implemented as one or more modules. The modules may advantageously be configured to reside on the computer memory and execute on the one or more processors. The modules include, but are not limited to, software or hardware components that perform certain tasks. Thus, a module may include, by way of example, components, such as, software components, processes, functions, subroutines, procedures, attributes, class components, task components, object-oriented software components, segments of program code, drivers, firmware, micro-code, circuitry, data, and the like.

The program logic conventionally includes the manipulation of data bits by the processor and the maintenance of these bits within data structures resident in one or more of the memory storage devices. Such data structures impose a physical organization upon the collection of data bits stored within computer memory and represent specific electrical or magnetic elements. These symbolic representations are the means used by those skilled in the art to effectively convey teachings and discoveries to others skilled in the art.

The program logic is generally considered to be a sequence of computer-executed steps. These steps generally require manipulations of physical quantities. Usually, although not necessarily, these quantities take the form of electrical, magnetic, or optical signals capable of being stored, transferred, combined, compared, or otherwise manipulated. It is conventional for those skilled in the art to refer to these signals as bits, values, elements, symbols, characters, text, terms, numbers, records, files, or the like. It should be kept in mind, however, that these and some other terms should be associated with appropriate physical quantities for computer operations, and that these terms are merely conventional labels applied to physical quantities that exist within and during operation of the computer.

It should be understood that manipulations within the computer are often referred to in terms of adding, comparing, moving, searching, or the like, which are often associated with manual operations performed by a human operator. It is to be understood that no involvement of the human operator may be necessary, or even desirable. The operations described herein are machine operations performed in conjunction with the human operator or user that interacts with the computer or computers.

It should also be understood that the programs, modules, processes, methods, and the like, described herein are but an exemplary implementation and are not related, or limited, to any particular computer, apparatus, or computer language. Rather, various types of general purpose computing machines or devices may be used with programs constructed in accordance with the teachings described herein. Similarly, it may prove advantageous to construct a specialized apparatus to perform the method steps described herein by way of dedicated computer systems with hard-wired logic or programs stored in nonvolatile memory, such as, by way of example, read-only memory (ROM).

Figure 4:
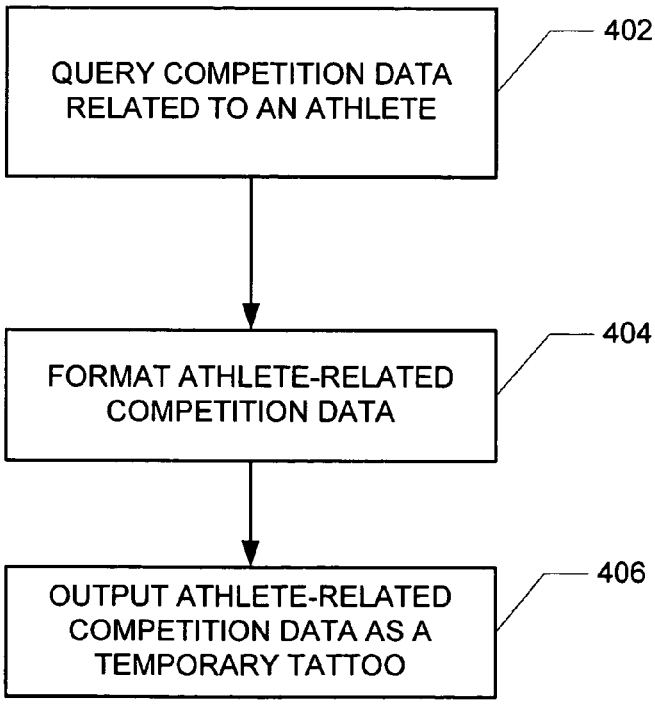
FIG. 4 is flow-chart illustrating the steps of performing the method using a computer system and outputting on temporary tattoo decal paper.

With this in mind, in a further embodiment of the present invention, is presented with reference to FIG. 4. First, competition data, including event description, event number, heat number and lane number for an athlete participating in a meet may be stored in memory of a computer or computer system. Competition data may be stored in a data base file or data structure in a memory storage device.

The data base or data structure may be queried to search for and assemble competition data related to an athlete 402, that athlete's data may be formatted for output 404, preferably into an array, and output 406.

Advantageously, output may take the form of printing, using a printing device controlled by a computer or computers, the information in the format specified upon temporary tattoo decal paper. The athlete need only apply the temporary tattoo to her skin and have the information specific to her readily available without resort to thumbing through a meet brochure, and without writing the information on the skin by hand.

Those skilled in the arts will recognize that the output format may be defined in any manner desired including the exemplary traditional two dimensional array shown in FIG. 2B. The output would be the array with the individual athlete's competition data populating the cells of the array. In addition, the output, again printed upon a temporary tattoo decal paper, could be designed to omit some or all of the grid lines of the array in FIG. 2B and simply display heading and competition data. For example, the Table 1A below represents exemplary output of an athlete's competition data for a particular athletic meet in an array format as it would appear on temporary tattoo decal paper, prior to application on the athlete's skin.

TABLE 1A

Exemplary output of Athlete's Competition data printed on temporary tattoo decal paper.

| NOITPIRCSED TNEVE | ENAL | TAEH | # TNEVE |
|---|---|---|---|
| YLFRETTUB M001 SYOB 41-31 | 3 | 3 | 02 |
| ELYTSEERF M05 SYOB 41-31 | 4 | 5 | 43 |
| YALER YELDEM M004 SYOB 41-31 | 5 | 2 | 05 |

Table 1B below shows the exemplary output of the same athlete's competition data for the same athletic meet in an array format as it would appear after application on the athlete's skin.

TABLE 1B

Exemplary output of Athlete's Competition as it would appear after temporary tattoo decal is applied to athlete's skin.

| EVENT # | HEAT | LANE | EVENT DESCRIPTION |
|---|---|---|---|
| 20 | 3 | 3 | 12–14 BOYS 100 M BUTTERFLY |
| 34 | 5 | 4 | 12–14 BOYS 50 M FREESTYLE |
| 50 | 2 | 5 | 12–14 BOYS 400 M MEDLEY RELAY |

Of course, as would be appreciated by those skilled in the relevant arts and as suggested by reversed appearance of the text in Table 1A, a computer used to generate the array must be configured to print the data not only-in the desired format, but also in the correct orientation. For instance, should it be necessary to print the data upon the temporary tattoo decal paper in reverse, as shown in Table 1A, then computer or printer must be programmed to do so.

As described above and shown in the associated drawings, the present invention comprises an apparatus for a method for recording multi-event athletic meet information on skin. While particular embodiments of the invention have been described, it will be understood, however, that the invention is not limited thereto, since modifications may be made by those skilled in the art, particularly in light of the foregoing teachings. It is, therefore, contemplated by the appended claims to cover any such modifications that incorporate those features or those improvements that embody the spirit and scope of the present invention.

What is claimed is:

1. A method for recording multi-event athletic competition information on an athlete's skin comprising the steps of:

a. printing a generally rectangular array consisting of a plurality of rows and a plurality of columns on said skin with an ink and using a stamp, said stamp having a die adapted to print said array such that when said ink is applied to said die and said die is applied to said skin, said array is perceivable on the surface of said skin; and b. populating said array with competition information.

2. The method of claim 1, wherein said step of populating said array comprises writing by hand upon said skin.

3. The method of claim 2, wherein said competition information is one or more of event number, event description, heat number, and lane number.

4. The method of claim 3, wherein said ink is resistant to erasure from exposure to liquid.

5. A method for recording multi-event athletic competition information on an athlete's skin comprising the steps of:

a. providing a stamp, said stamp comprising a die, said die being configured an embossment such that when an ink is applied to said die and said die is impressed upon said skin, an array is displayed, said array having columns and rows; and b. writing said competition information in said array.

6. The method of claim 5, wherein said competition information is one or more of event number, event description, heat number, and lane number.

7. The method of claim 6, wherein said ink is resistant to erasure from exposure to liquid.

8. The method of claim 5, wherein said ink is resistant to erasure from exposure to liquid.

* * * * *